US006667721B1

(12) United States Patent
Simonds

(10) Patent No.: US 6,667,721 B1
(45) Date of Patent: Dec. 23, 2003

(54) COMPACT BROAD BAND ANTENNA

(75) Inventor: Hale Bradford Simonds, Santee, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/267,415

(22) Filed: Oct. 9, 2002

(51) Int. Cl.[7] ..... H01Q 13/00
(52) U.S. Cl. ..... 343/773; 343/774; 343/905
(58) Field of Search ..... 343/752, 773, 343/774, 775, 905

(56) References Cited

U.S. PATENT DOCUMENTS

| | | | | |
|---|---|---|---|---|
| 2,511,849 A | * | 6/1950 | Hilferty et al. | 343/773 |
| 4,143,377 A | * | 3/1979 | Salvat et al. | 343/755 |
| 4,225,869 A | | 9/1980 | Lohrmann | |
| 4,835,542 A | | 5/1989 | Sikina | |
| 4,890,117 A | * | 12/1989 | de Ronde | 343/773 |
| 5,134,420 A | | 7/1992 | Rosen et al. | |
| 5,140,334 A | | 8/1992 | Snyder et al. | |
| 5,534,880 A | | 7/1996 | Button et al. | |
| 5,923,299 A | | 7/1999 | Brown et al. | |
| 6,154,182 A | * | 11/2000 | McLean | 343/773 |
| 6,268,834 B1 | * | 7/2001 | Josypenko | 343/773 |
| 2003/0107524 A1 | * | 6/2003 | Hart | 343/860 |

OTHER PUBLICATIONS

W.L. Barrow et al, Biconical Electromagnetic Horns, Proceeding of the I.R.E., Dec. 1939, pp 769–779.

* cited by examiner

*Primary Examiner*—Tan Ho
(74) *Attorney, Agent, or Firm*—Allan Y. Lee; Michael A. Kagan; Peter A. Lipovsky

(57) ABSTRACT

A broad band antenna uses a bicone antenna configuration as a feed transformer and exponentially tapered reflector fins to radiate the antenna's energy. The bicone antenna design is used to match the antenna's impedance to coaxial cable impedance. The fins function to reduce the traditional bicone antenna diameter. Reflection between the cones and the attached reflector fins as well as return loss are reduced by wrapping the reflector fins with metallic foil.

15 Claims, 11 Drawing Sheets

TIME: 15: 01: 41
GAIN STANDARD REFERENCE = 1 dBi
NORMALIZING POWER = -28.5 dBm: FREQUENCY = .2 GHZ
WITH HOOPS AND AL TAPE

TIME: 15: 40: 51
GAIN STANDARD REFERENCE = 6.7 dBi
NORMALIZING POWER = -33.8 dBm: FREQUENCY = 1 GHZ
WITH HOOPS AND AL TAPE

TIME: 16:17:04
GAIN STANDARD REFERENCE = 9.5 dBi
NORMALIZING POWER = -28.3 dBm FREQUENCY = 4 GHZ
WITH HOOPS AND AL TAPE

TIME: 16: 52: 55
GAIN STANDARD REFERENCE = 10.8 dBi
NORMALIZING POWER = -46 dBm FREQUENCY = 8 GHZ
WITH HOOPS AND AL TAPE

TIME: 16: 03: 16
GAIN STANDARD REFERENCE = 1 dBi
NORMALIZING POWER = -35.1 dBm: FREQUENCY = .2 GHZ
@ 180 DEG AZ / ON SIDE IN CHAMBER

TIME: 15: 47: 28
GAIN STANDARD REFERENCE = 16.2 dBi
NORMALIZING POWER = -35.3 dBm: FREQUENCY = 2 GHZ
@ 180 DEG AZ / ON SIDE IN CHAMBER

TIME: 15: 43: 10
GAIN STANDARD REFERENCE = 11.6 dBi
NORMALIZING POWER = -31.2 dBm FREQUENCY = 1 GHZ
@ 180 DEG AZ / ON SIDE IN CHAMBER

COMPACT BROAD BAND ANTENNA

BACKGROUND OF THE INVENTION

The following invention relates to antennas and more specifically to broad band antennas of bicone design.

It is desirable to provide an omnidirectional vertically polarized antenna that operates over a wide frequency band. If this goal is met, programmable radios that operate over a wide frequency band can then be connected to a single antenna. The antenna could also be used for several radio systems, thereby reducing the number of antennas required.

It is typical to provide dedicated antennas for each radio frequency band used. These bands are typically 10 to 50% of the center frequency of operation. For example, military ultra high frequency (UHF) radios typically operate from 225 to 400 MHz. The antenna used for these radios operate only over this band. For radios operating over other bands, an antenna will be used for each of the radios.

Such dedicated antennas are commonly used on shipboard systems, resulting in an "antenna farm" on the ship's topside and/or many antennas mounted on the ship's mast. In those instances where broad band antennas are used, such as with electronic counter measure equipment, the antennas are usually based on class bicone antenna designs that are very large in size.

There is thus a need for a broad band antenna that can be used for a number of communication systems while at the same time is of minimal size.

SUMMARY OF THE INVENTION

The invention is a broad band antenna that uses a bicone antenna configuration as a feed transformer and exponentially tapered reflector fins to radiate the antenna's energy. The fins function to reduce the traditional bicone antenna diameter. Reflection between the cones and the attached reflector fins as well as return loss are substantially reduced by wrapping the reflector fins with metallic foil.

Other objects, advantages and new features of the invention will become apparent from the following detailed description of the invention when considered in conjunction with the accompanied drawings.

DESCRIPTION OF THE INVENTION

The most critical part of a broadband antenna is its feed. In narrow band antennas a matching section is used to match the impedance of the input coaxial cable feed to the impedance of the antenna. In broad band antennas, matching sections are not feasible as matching sections will function similarly to bandpass filters. The matching sections will limit the bandwidth of the antenna operation.

In order for a broadband antenna to operate over a broad bandwidth, the impedance of the antenna must closely match the impedance of the antenna feed. Such an antenna feed is typically an input from a 50 Ohm coaxial cable.

In the *Antenna Engineering Handbook*, Second Edition, by Richard Johnson and Henry Jasik, it can be learned that a bicone antenna with cone angles of 65 degrees will have an input impedance of approximately 50 Ohms. Such an antenna will be inherently broadband because of this impedance match. The disadvantage of this antenna is that with a 65 degree cone angle, an antenna designed for operation at 200 MHz will be 56 inches in diameter and have a height of 27 inches. The size of this antenna is too large for most shipboard and land mobile applications.

Figure 1:
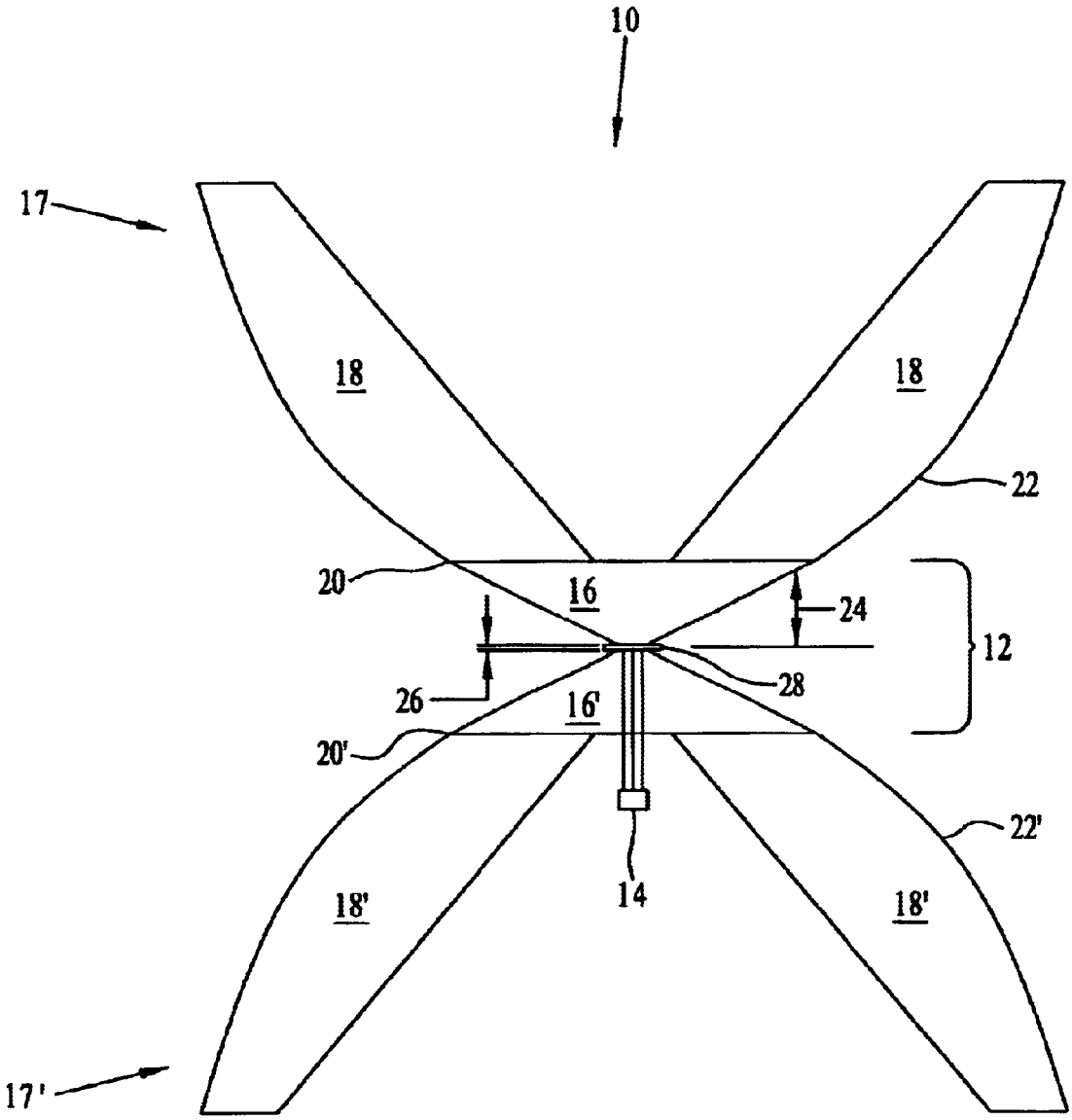
FIG. 1 is a side view of an exemplary embodiment of the invention.

Referring to FIG. 1, antenna 10 incorporates a bicone antenna configuration 12 as an antenna feed to match the impedance of the antenna to the impedance of coaxial cable input 14. Cable 14 has a first conductor that is connected to first cone 16 and a second conductor that is connected to second cone 16'.

The bicone feed establishes a transverse electromagnetic (TEM) wave mode on the antenna surfaces and is shown to include two opposing hollow cones that each have straight-line profiles. Though substantially identical straight-line profile cones are disclosed, a skilled artisan will realize that cones of other profiles and combinations of profiles may also be employed and still be confined within the spirit of this invention.

Once the TEM mode is established, the generated energy is radiated into space by way of first and second exponentially tapered radiators 17 and 17'. These radiators may include first and second pluralities 18 and 18' of exponentially tapered conductive fins. The fins are attached at base regions 20 and 20' of cones 16 in a conventional way, not shown, wherein the fins each include an outer surface 22/22' that are substantially contiguous with the outer surfaces of the cones. For an antenna feed 14 that equates with the 50 Ohm antenna input impedance, cone angle 24 will be 65 degrees. One skilled in the art will realize however that other cone angles may be used to adjust impedance matching where necessary.

Figure 2:
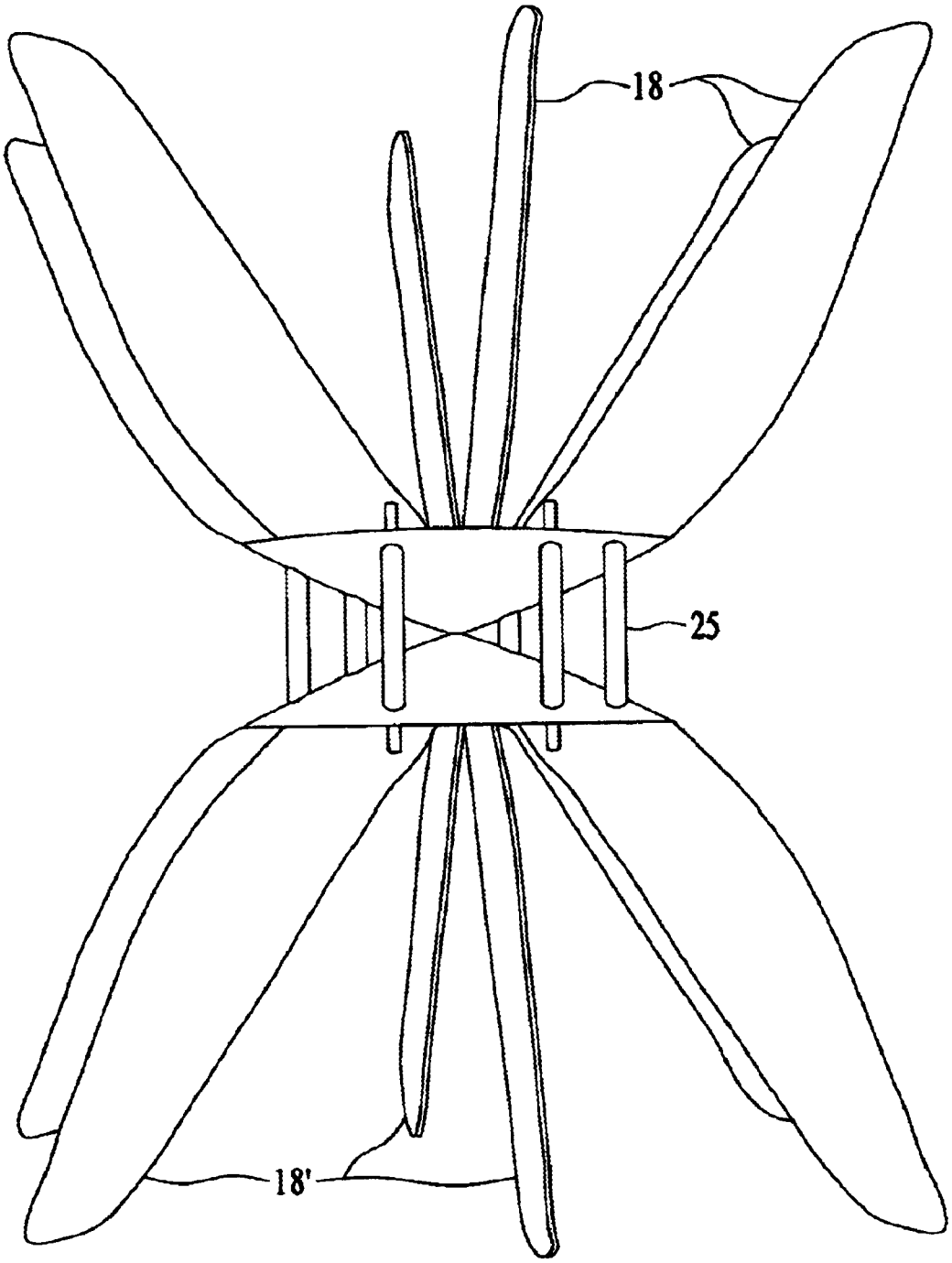
FIG. 2 is a perspective view of an exemplary embodiment of the invention.

When used in conjunction with a 65 degree cone angle, antenna 10 is approximately 23 inches in diameter and 25 inches in height and is suitable for radiating energy from 130 MHz to 8.0 GHZ. FIG. 2 illustrates a perspective of the invention wherein it can be seen in this example two sets of reflector fins 18 and 18' wherein each set includes six fins. In this embodiment the fins are arranged with equal 60 degree fin spacing. It can be envisioned that other number of fins and fin spacing are possible while staying within the scope of this invention. Also shown in this figure are bicone supports 25 that are of a dielectric material.

Referring again to FIG. 1, optimization of the antenna described above is furthered by utilizing a feed gap 26 of 0.095 inches and the installation of an anti-arcing washer 28. For the specifications of the invention described above, the washer was made 1.5 inches in diameter and was of Dupont trademarked Teflon material. Besides minimizing arcing between the cones of the invention, the spacer also promotes a desired distance or spacing between the cones.

Figure 3:
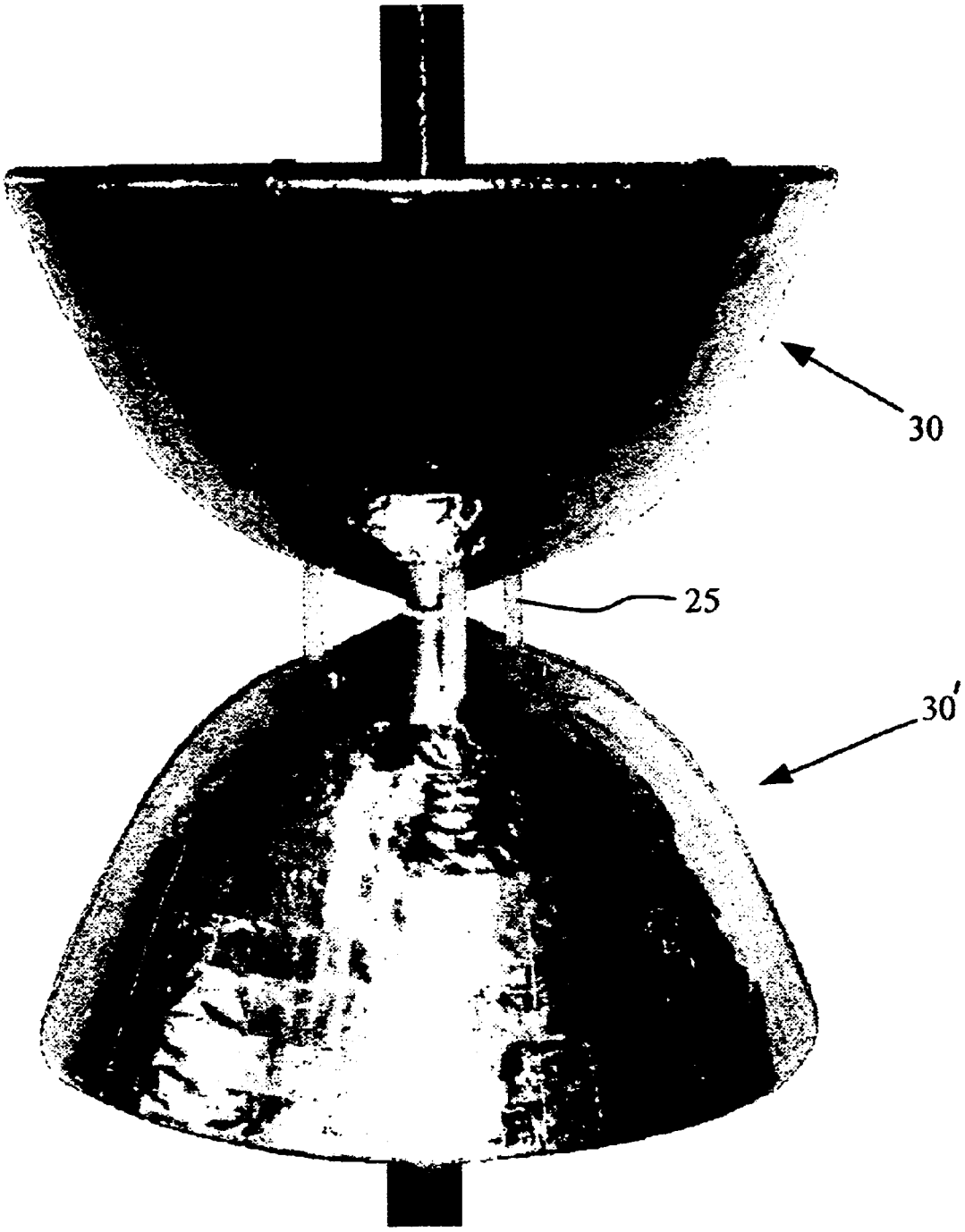
FIG. 3 is a detailed side view of an exemplary embodiment of the invention shown with foil layers in place.

Referring now to FIG. 3, further optimization of the invention is achieved by covering the reflector fins with a thin metal foil 30/30' such as aluminum foil. When a prototype of the invention was tested without the foil for return loss, a large reflection occurred at approximately 1.0 Ghz. This reflection was considered caused by the reflection from the transition from the bicone feed to the exponentially tapered fins. When the exponentially shaped fin reflectors were covered with aluminum foil, the reflection at 1.0 GHz was significantly reduced and the return loss was reduced over a wide frequency band. This foil may be further supported by axially aligned hoops disposed over the reflector fins.

Figure 4:
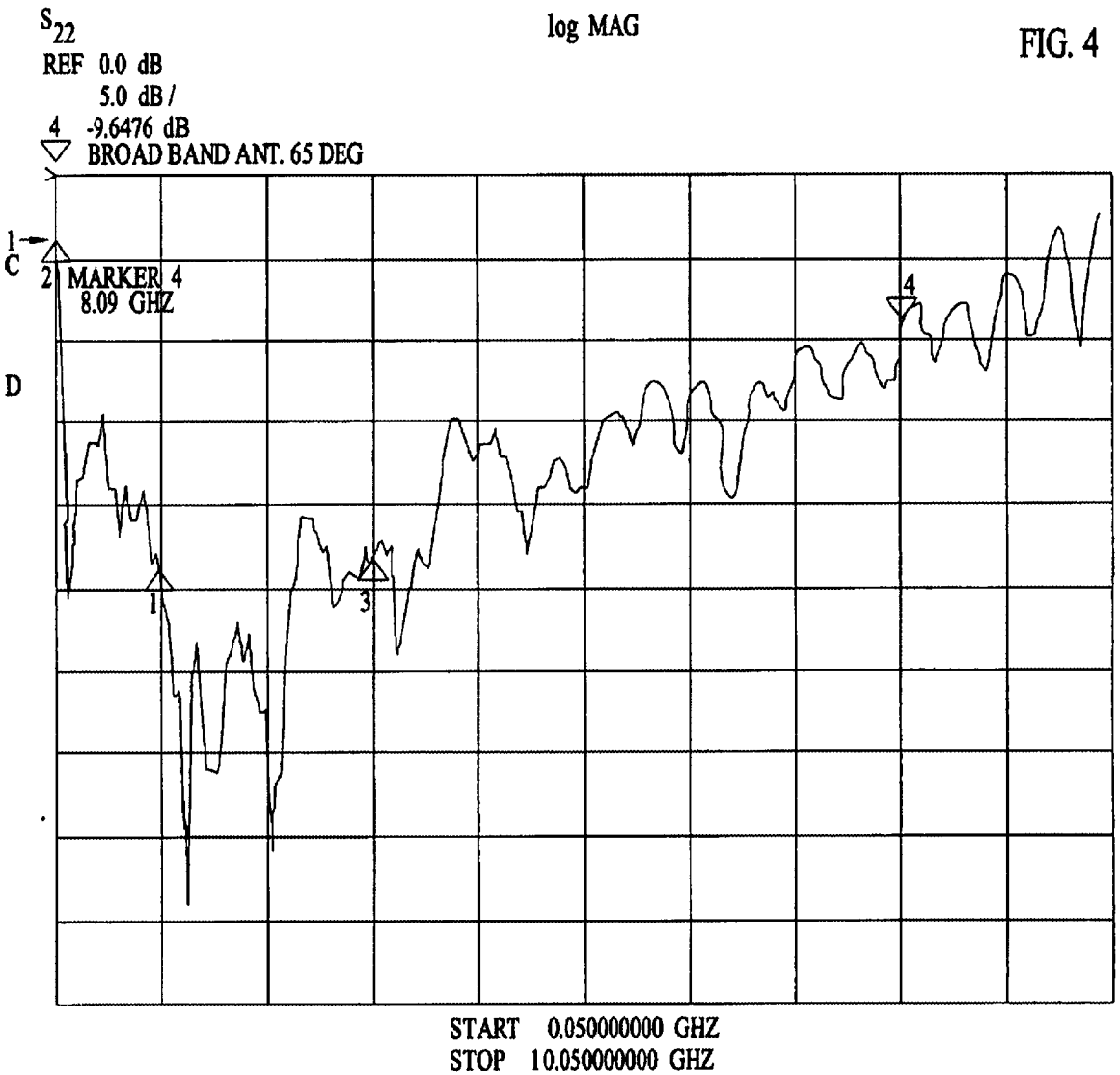
FIG. 4 illustrates return loss for an embodiment of the invention.
Figure 5A:
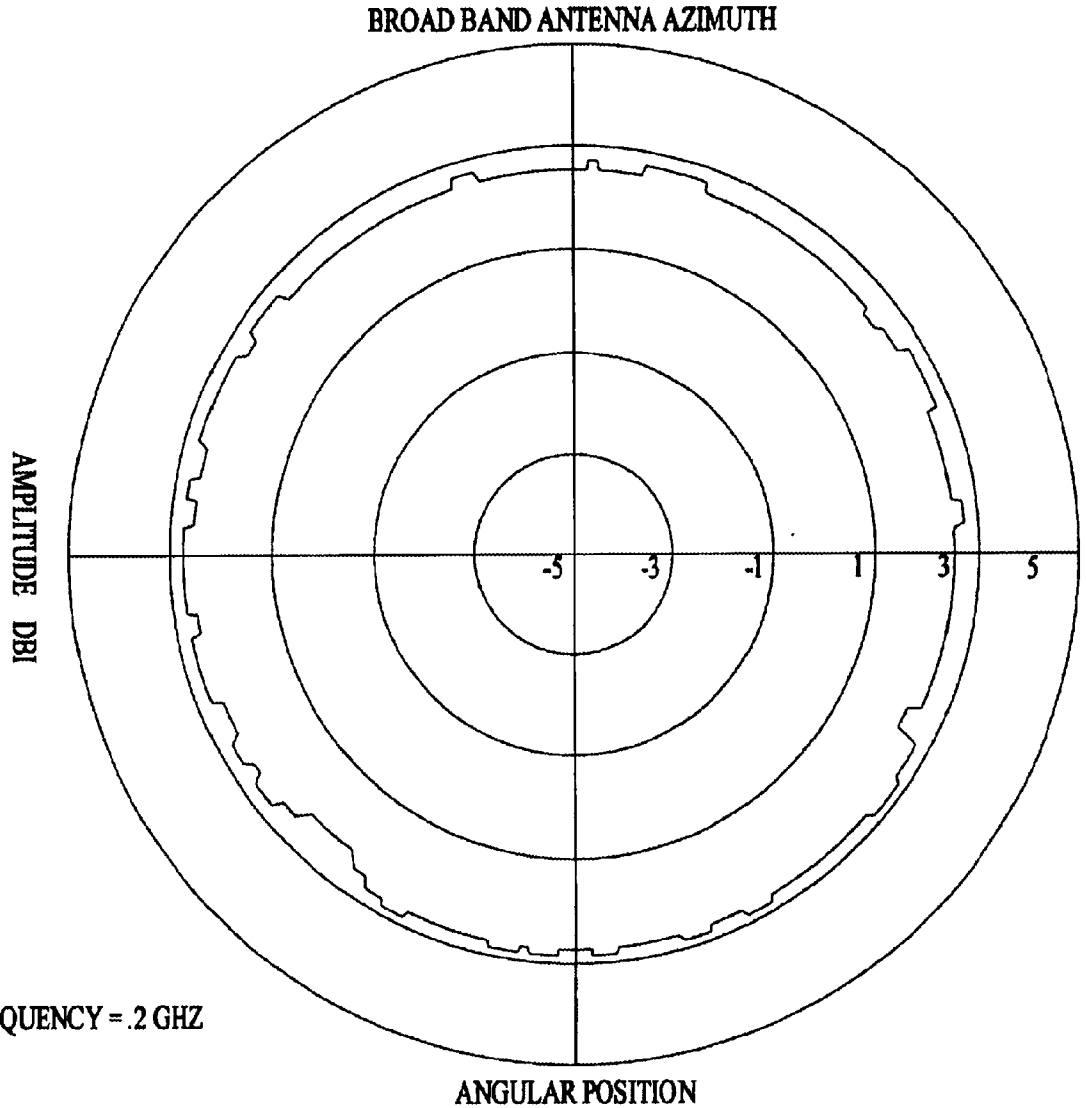
FIGS. 5A–G are azimuth and elevation patterns for an embodiment of the invention.
Figure 5B:
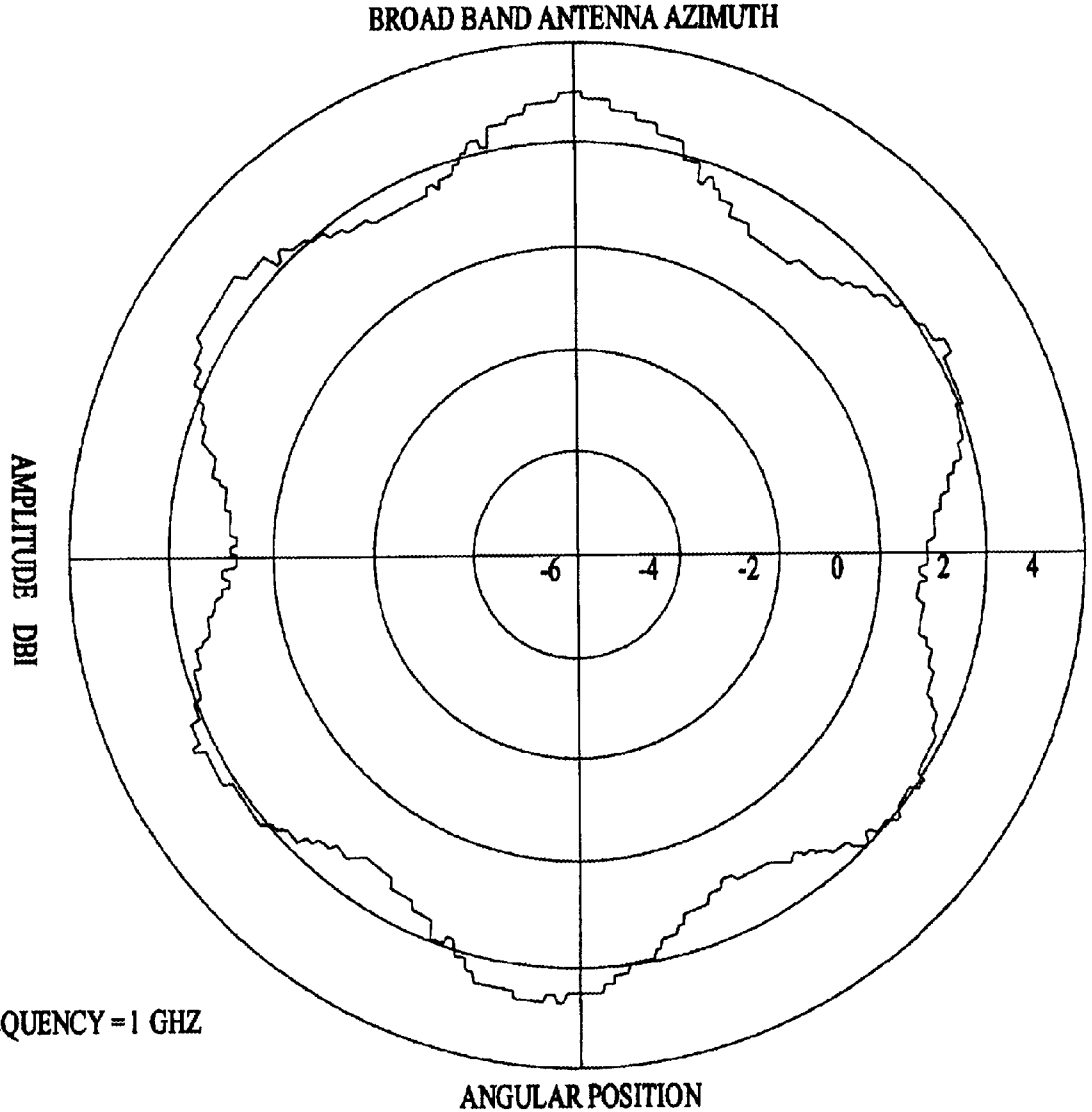
Figure 5C:
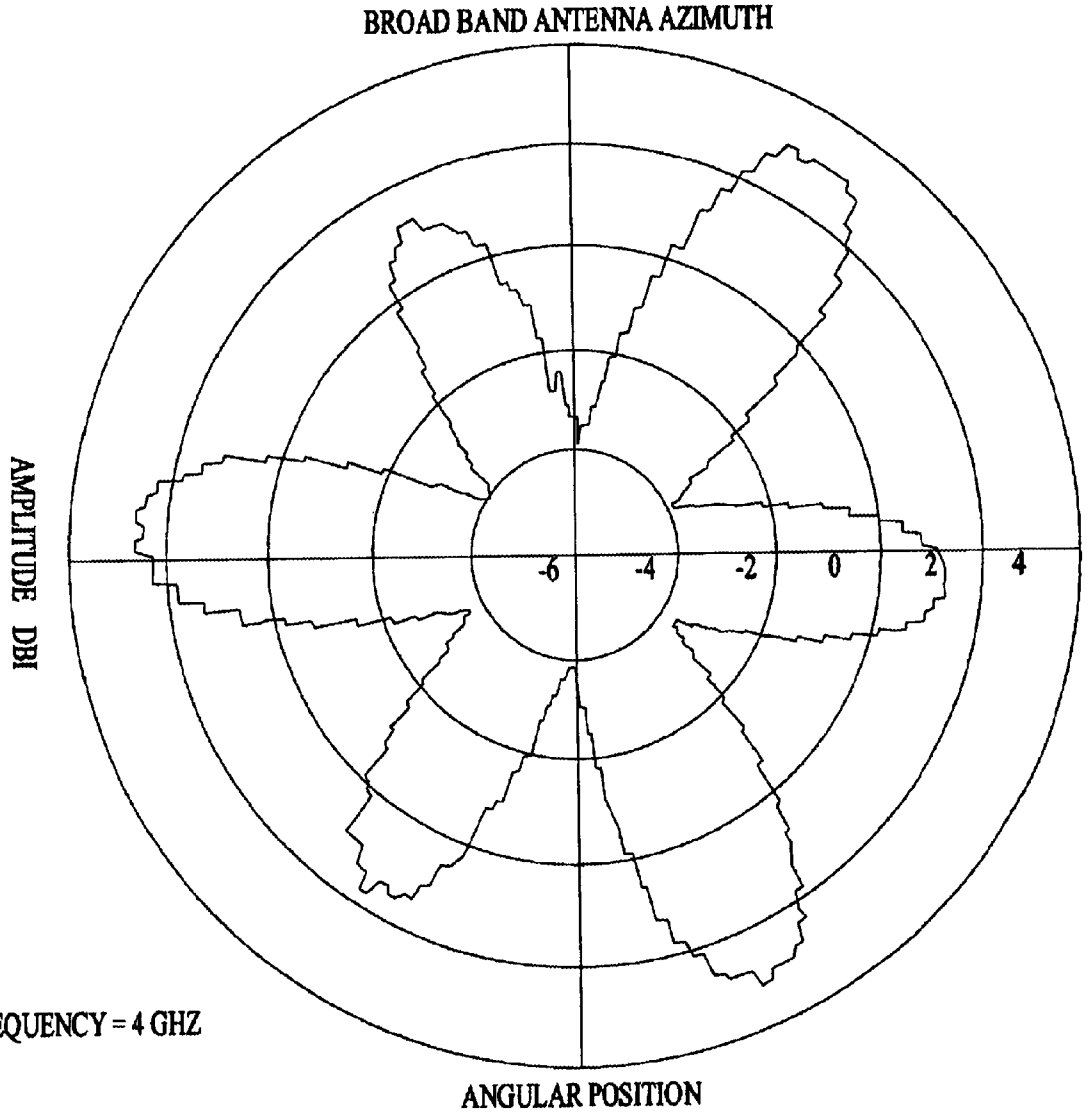
Figure 5D:
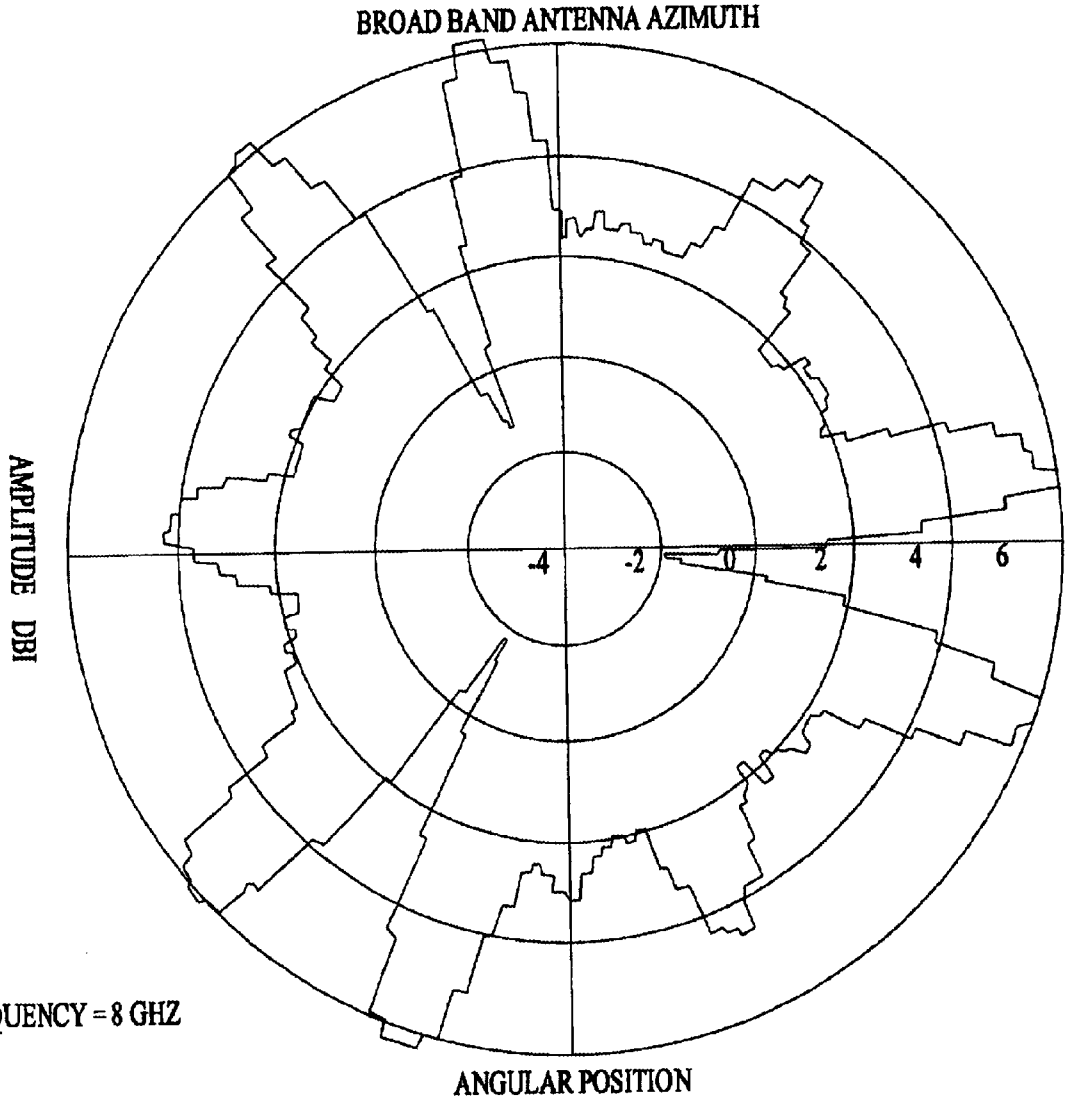
Figure 5E:
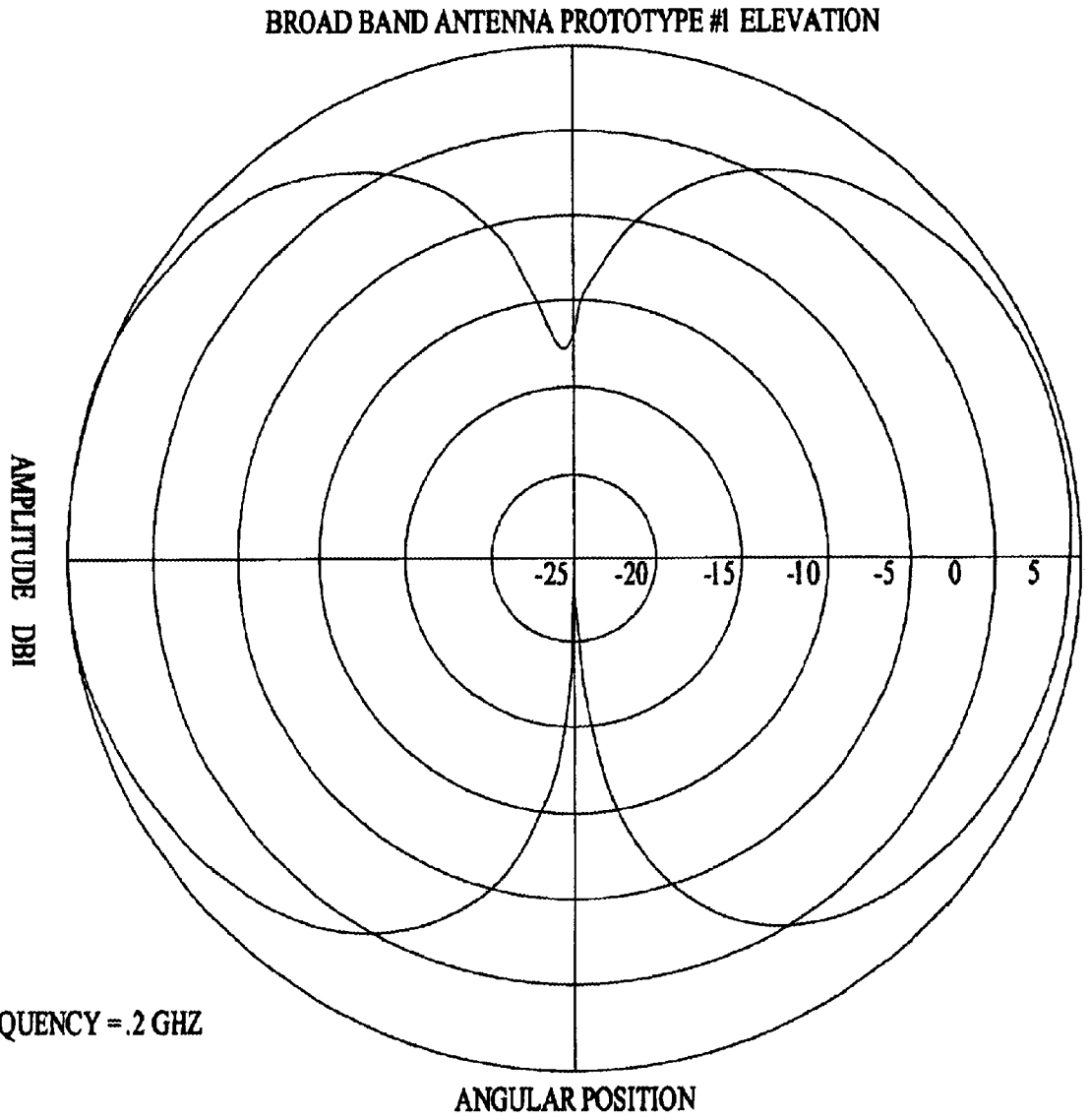
Figure 5F:
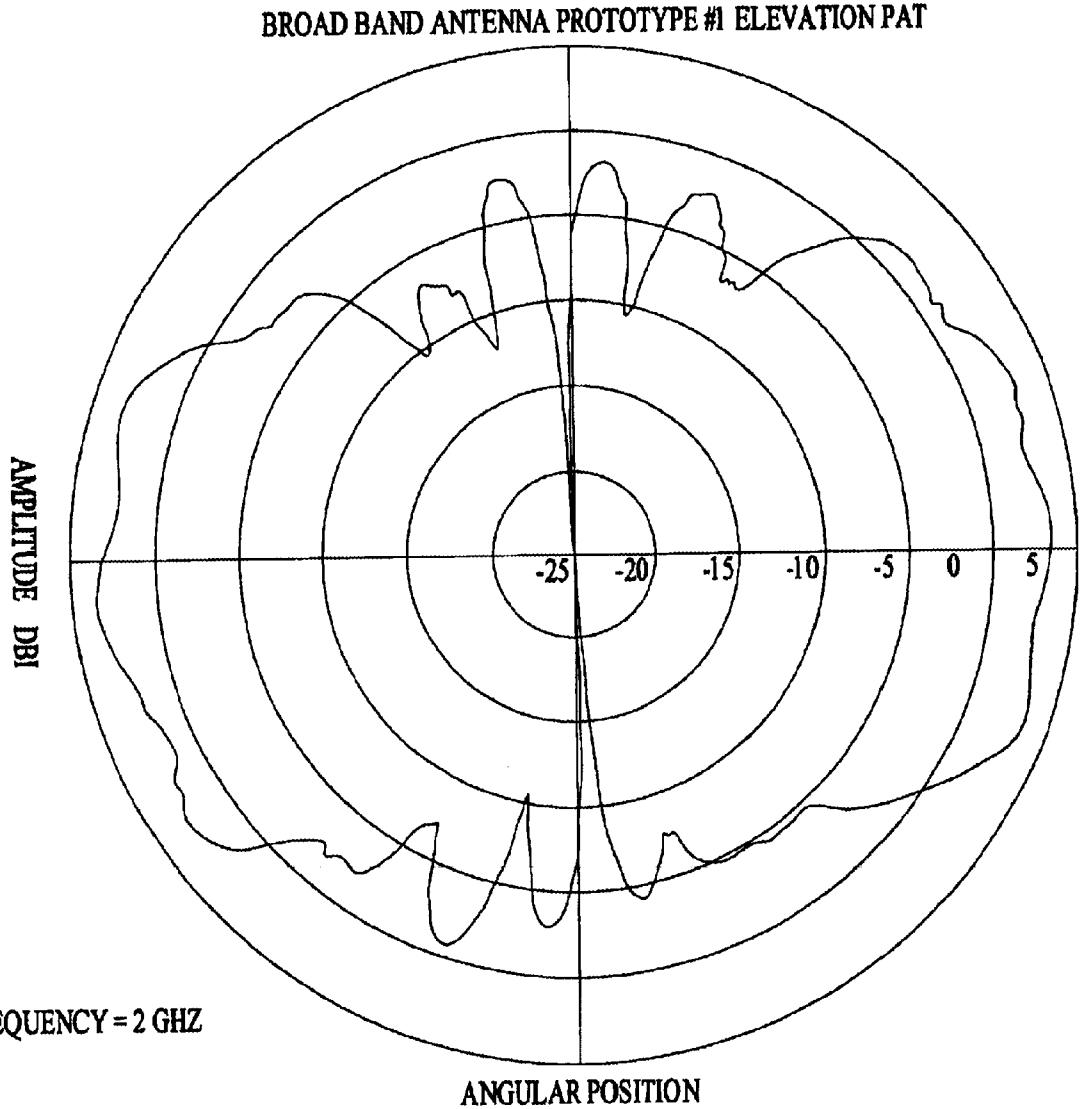
Figure 5G:
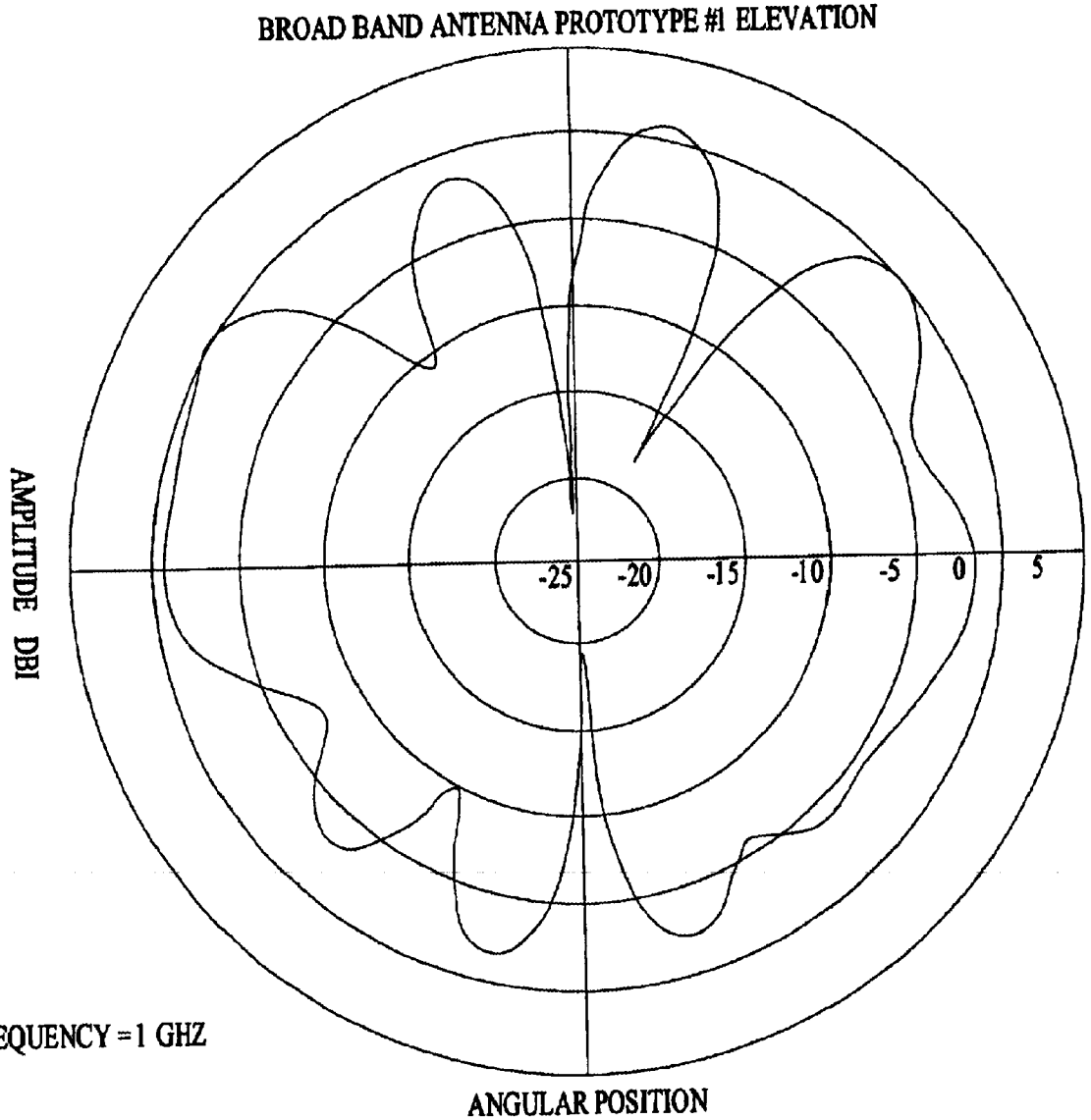

FIG. 4 shows the broad band return loss of the antenna of the invention described above. The graph depicts frequency along its horizontal axis starting left-to-right at 0.05 Ghz and extending to 10.5 Ghz. The graph shows the antenna radiating at a return loss less than 10 dB (1.9:1 voltage standing wave ratio (VSWR) from 130 MHz to 9.0 Ghz.

Azimuth and elevation patterns were taken at 200 MHz, 400 MHz, 500 MHz, 1.0 GHz, 1.5 GHz, and 2.0 GHz. for the specific embodiment of the invention described above. This data showed a typical gain over this band of 1.0 dBi, an omnidirectional antenna pattern in azimuth at the horizon and an elevation pattern similar to that of a dipole antenna.

FIGS. 5A–G show the azimuth and elevation patterns of the example antenna. Azimuth readings were taken at 200 MHz and 1.0, 4.0 and 8.0 GHz. The azimuth pattern in the 1.0 GHz region has azimuth ripple caused by the bicone foil interface and bicone supports. Elevation patters are shown for 0.2, 1.0 and 2.0 GHz.

The invention provides numerous advantages. It permits a transmit and receive capability over a broad frequency band (130 MHz to 9.0 GHz., for example) in a single antenna, instead of several antennas and coupling devices or switches. By using the invention, the number of antennas and required mast antenna space on a ship can be reduced. The invention can be used with broad band programmable radios. The invention also provides a reduced size compared to a classical bicone antenna.

By using a bicone antenna configuration as an antenna feed, the frequency band of operation of the antenna is increased. The invention also utilizes an exponentially taped reflector which reduces the antenna diameter over that of the classical bicone antenna.

Though an example of the invention has been described this example is not intended or to be implied that this example is the only implementation of the invention.

While the bicone and radiating elements of the invention described above may lend themselves to be made of metal, it can be envisioned that these elements could be fabricated of fiberglass that is metallized for radiating and conducting purposes. It can also be envisioned that the antenna can be fabricated using a "spun" aluminum structure such as one with holes in the exponential reflector. Similarly, a radome could be built into the bicone feed area as well over the exponential reflector. Additionally, a polarizer could be added into the radome to produce slant, circular or horizontal polarization.

Obviously, many modifications and variations of the invention are possible in light of the above description. It is therefore to be understood that within the scope of the claims the invention may be practiced otherwise than as has been specifically described.

What is claimed is:

1. An antenna apparatus comprising:

an antenna feed line including first and second conductors;

a pair of coaxially disposed, substantially identical, hollow cones, each of said cones having an apex region and a base, said cones arranged so that said apex regions are adjacent and in which one of said cones is connected to said first conductor and a second of said cones is connected to said second conductor;

a disk-shaped insulating spacer axially aligned with and disposed between said cones to space said cones a predetermined distance and to minimize arcing between said cones; and first and second exponentially tapered radiators, said first radiator attached at said base of said first cone and said second radiator attached at said base of said second cone wherein an outer periphery of said radiators is exponentially curved and is substantially contiguous with an outer surface of said hollow cones.

2. The apparatus of claim 1 wherein said antenna feed is a coaxial antenna feed.

3. The apparatus of claim 1 wherein an axially aligned cross-section of said cones has a straight-line profile.

4. An omnidirectional, ultra-wideband, vertically polarized antenna apparatus comprising:

an antenna feed line including first and second conductors;

a pair of coaxially disposed, substantially identical, hollow cones, each of said cones having an apex region, a cone angle and a base, said cones arranged so that said apex regions are adjacent and in which one of said cones is connected to said first conductor and a second of said cones is connected to said second conductor;

a disk-shaped insulating spacer axially aligned with and disposed between said cones to space said cones a predetermined distance and to minimize arcing between said cones;

first and second pluralities of radially disposed conductive reflector fins, said first plurality of reflector fins attached at said base of said first cone and said second plurality of reflector fins attached at said base of said second cone wherein a radially outer periphery of said fins is exponentially curved and is substantially contiguous with an outer surface of said hollow cones; and first and second metallic foil layers respectively disposed circumferentially about said first and second pluralities of radially disposed conductive reflector fins.

5. The apparatus of claim 4 wherein said antenna feed is a coaxial antenna feed.

6. The apparatus of claim 4 wherein an axially aligned cross-section of said cones has a straight-line profile.

7. The apparatus of claim 4 wherein said disk-shaped insulating spacer includes Teflon.

8. The apparatus of claim 7 wherein said predetermined distance of said disk-shaped insulating spacer is 0.095 inches.

9. The apparatus of claim 4 wherein said first and second pluralities of radially disposed conductive reflector fins each include six fins with sixty degree spacing between said fins.

10. The apparatus of claim 4 wherein said metallic foil layer comprises aluminum foil.

11. The apparatus of claim 4 wherein said cone angle of said cones is 65 degrees.

12. An omnidirectional, ultra-wideband, vertically polarized antenna apparatus comprising:

a coaxial antenna feed line including first and second conductors;

a pair of coaxially disposed, substantially identical, straight-line profiled hollow cones, each of said cones having an apex region, a 65 degree cone angle and a base, said cones arranged so that said apex regions are adjacent and in which one of said cones is connected to said first conductor and a second of said cones is connected to said second conductor;

a disk-shaped insulating spacer axially aligned with and disposed between said cones to space said cones a predetermined distance and to minimize arcing between said cones;

first and second pluralities of radially disposed conductive reflector fins, said first plurality of reflector fins including six fins attached at said base of said first cone at sixty degree intervals said second plurality of reflector fins including six fins attached at said base of said second cone at sixty degree intervals wherein a radially outer periphery of said fins is exponentially curved and is substantially contiguous with an outer surface of said hollow cones; and first and second metallic foil layers respectively disposed circumferentially about said first and second pluralities of radially disposed conductive reflector fins.

13. The apparatus of claim 12 wherein said disk-shaped insulating spacer includes Teflon.

14. The apparatus of claim 12 wherein said metallic foil layer comprises aluminum foil.

15. The apparatus of claim 12 wherein said predetermined distance of said disk-shaped insulating spacer is 0.095 inches.

* * * * *